US008240090B2

(12) United States Patent
Meeks et al.

(10) Patent No.: US 8,240,090 B2
(45) Date of Patent: Aug. 14, 2012

(54) CORNER PAD FOR A DOOR ASSEMBLY

(75) Inventors: James W. Meeks, Eaton, OH (US); Brian S. Hewitt, Eaton, OH (US)

(73) Assignee: Quanex Building Products Corporation, Houston, TX (US)

( * ) Notice: Subject to any disclaimer, the term of this patent is extended or adjusted under 35 U.S.C. 154(b) by 1247 days.

(21) Appl. No.: 11/779,040

(22) Filed: Jul. 17, 2007

(65) Prior Publication Data

US 2008/0010904 A1 Jan. 17, 2008

Related U.S. Application Data

(60) Provisional application No. 60/831,274, filed on Jul. 17, 2006.

(51) Int. Cl.
*E06B 7/16* (2006.01)

(52) U.S. Cl. ..... 49/475.1; 49/504

(58) Field of Classification Search ..... 49/504, 49/475.1, 493.1

See application file for complete search history.

(56) References Cited

U.S. PATENT DOCUMENTS

| | | | | |
|---|---|---|---|---|
| 3,250,040 | A * | 5/1966 | Squires | 49/482.1 |
| 3,676,888 | A | 7/1972 | Akers | |
| D233,586 | S | 11/1974 | Kopp | |
| 3,851,420 | A * | 12/1974 | Tibbetts | 49/471 |
| 4,411,104 | A * | 10/1983 | St. Aubin | 49/470 |
| 4,686,893 | A * | 8/1987 | Jinkins | 454/284 |
| 4,726,147 | A * | 2/1988 | Beske et al. | 49/406 |
| D368,344 | S | 3/1996 | Hansen | |
| 5,857,291 | A * | 1/1999 | Headrick | 49/368 |
| 6,219,971 | B1 * | 4/2001 | Headrick | 49/469 |
| 6,223,477 | B1 | 5/2001 | Alley | |
| 6,491,326 | B1 | 12/2002 | Massey et al. | |
| 6,637,158 | B2 * | 10/2003 | Bennett | 49/504 |
| D481,625 | S | 11/2003 | Ellsworth | |
| 6,665,989 | B2 * | 12/2003 | Bennett | 52/287.1 |
| 7,263,808 | B2 * | 9/2007 | Massey et al. | 52/204.1 |
| D578,872 | S | 10/2008 | Healy | |
| D588,905 | S * | 3/2009 | Meeks et al. | D8/400 |
| 2002/0035810 | A1 * | 3/2002 | Bennett | 52/287.1 |

(Continued)

OTHER PUBLICATIONS

U.S. Appl. No. 11/690,617, filed Mar. 23, 2007, entitled "Astragal Boot", Applicant: James Meeks.

(Continued)

*Primary Examiner* — Katherine W Mitchell
*Assistant Examiner* — Catherine A Kelly
(74) *Attorney, Agent, or Firm* — Howard & Howard Attorneys PLLC

(57) ABSTRACT

A door assembly for disposition in a building includes a vertical member, a weather strip adjacent the vertical member, and a door selectively moveable to be adjacent the weather strip opposite the vertical member. A threshold extends below the door and the vertical member extends upwardly from a lower end. A corner pad is mounted to the lower end of the vertical member. The corner pad includes a base surface abutting the threshold, a first edge surface extending upwardly from the base surface between the vertical member and the weather strip, and a lower reservoir surface extending upwardly from the first edge surface. The lower reservoir surface extends inwardly into the corner pad defining a reservoir between the vertical member and the weather strip. The corner pad includes a second reservoir surface extending angularly from said lower reservoir surface for preventing the water from splashing out of said reservoir and into an interior of the building.

25 Claims, 6 Drawing Sheets

U.S. PATENT DOCUMENTS

| | | | | |
|---|---|---|---|---|
| 2003/0052492 | A1 | 3/2003 | Massey et al. | |
| 2004/0139667 | A1 | 7/2004 | Massey et al. | |
| 2006/0150517 | A1 | 7/2006 | Meeks et al. | |
| 2007/0079557 | A1 | 4/2007 | Pepper et al. | |
| 2007/0227076 | A1* | 10/2007 | Braun | 49/505 |
| 2008/0010904 | A1 | 1/2008 | Meeks et al. | |

OTHER PUBLICATIONS

U.S. Appl. No. 11/690,646, filed Mar. 23, 2007, entitled "Lock Block Assembly for an Astragal", Applicant: James Meeks.

* cited by examiner

CORNER PAD FOR A DOOR ASSEMBLY

CROSS-REFERENCE TO RELATED APPLICATIONS

The subject patent application claims priority to and all the benefits of U.S. Provisional Patent Application Ser. No. 60/831,274 which was filed on Jul. 17, 2006, the entire specification of which is incorporated herein by reference.

BACKGROUND OF THE INVENTION

1. Field of the Invention

The invention generally relates to a corner pad for disposition in a door assembly of a building. Specifically, the corner pad is disposed between a vertical member of the door assembly and a weather seal to prevent the passage of water and other debris between a door and the weather seal.

2. Description of the Related Art

Door assemblies are disposed in an opening of a building, such as a commercial or residential building to separate an interior of the building from an exterior of the building. Door assemblies include a frame having a vertical member, a second vertical member, and a door rotatably mounted to the second vertical member such that the door is rotatable between an open and closed position. A threshold is disposed below the door and extends between the vertical member and the second vertical member.

A weather strip is disposed along the vertical member. The weather strip includes a stationary leg and a flexible leg extending from the stationary leg. The weather strip is disposed between and seals to the door and the vertical member when door is in the closed position to minimize the passage of water, draft, and dirt between the door and the vertical member from the exterior of the building to the interior of the building. However, during a rain storm accompanied by high wind, water puddles near the door. The wind forms a pressure head at the door in the exterior of the building and water seeps between the weather strip and the door from the exterior of the building to the interior of the building.

To minimize the seepage of water between the weather strip and the door, a corner pad extends along a portion of the second vertical member at the intersection of the vertical member and the threshold. The corner pad includes a base surface abutting the threshold. The corner pad also includes a mounting face extending from the base surface and an opposite face spaced from the mounting face and extending from the base surface with the mounting surface mounted to the vertical member.

However, during a rain storm accompanied by high wind, the water puddled near the threshold is able to wick upwardly along the weather strip because the stationary and flexible legs of the weather strip abutting the corner pad form an elongated bore and the pressure head forces the water up the elongated bore. The water wicks upwardly over the corner pad and is therefore still able to penetrate into the interior of the building.

When a sufficient pressure head exists across the door between the exterior and interior of the building, water sprays and splashes from the bore. Attempts have been made in the prior art to decrease the size of the bore. However, decreasing the size of the bore results in the air and water wicking upwardly through the bore at a greater velocity for any given pressure head in the exterior of the building. Corner pads of the prior art have been deficient in sufficiently preventing the wicking of water upwardly over the corner pad and into the interior of the building.

Accordingly, it would be desirable to manufacture a corner pad that prevents the passage of water between the door and the second vertical member. Specifically, it would be desirable to trap the water to prevent the water from flowing and/or spraying into the interior of the building.

SUMMARY OF THE INVENTION AND ADVANTAGES

The present invention is a corner pad for disposition in a door assembly in a building. The corner pad includes a base surface. A mounting face extends in a first direction from the base surface and an opposite face spaced from the mounting face extends in the first direction from the base surface. A first edge surface extends in the first direction from the base surface between the mounting face and the opposite face. A lower reservoir surface extends from the first edge surface between the mounting face and the opposite face and extends from the first edge surface away from the base surface and inwardly from the first edge surface defining a reservoir for collecting water. A second reservoir surface extends from the lower reservoir surface between the mounting face and the opposite face and extends from the lower reservoir surface angularly relative to the lower reservoir surface for preventing the water from splashing out of the reservoir and into an interior of the building.

Accordingly, the reservoir prevents the upward wicking of water along the corner pad during a rain storm accompanied by wind. Specifically, the upward wicking of the water is interrupted by the lower reservoir surface to prevent the passage of the water over the corner pad to the interior of the building. As water wicks upwardly, the water accumulates in the reservoir. Water that sprays into the reservoir is blocked by the second reservoir surface to prevent the spraying water from spraying over the corner pad and into the interior of the building. When the wind subsides, the water accumulated in the reservoir drains downwardly along the first edge surface to an exterior of the building. The interruption of the flow of water along the first edge surface results in a higher water resistance rating for the door assembly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
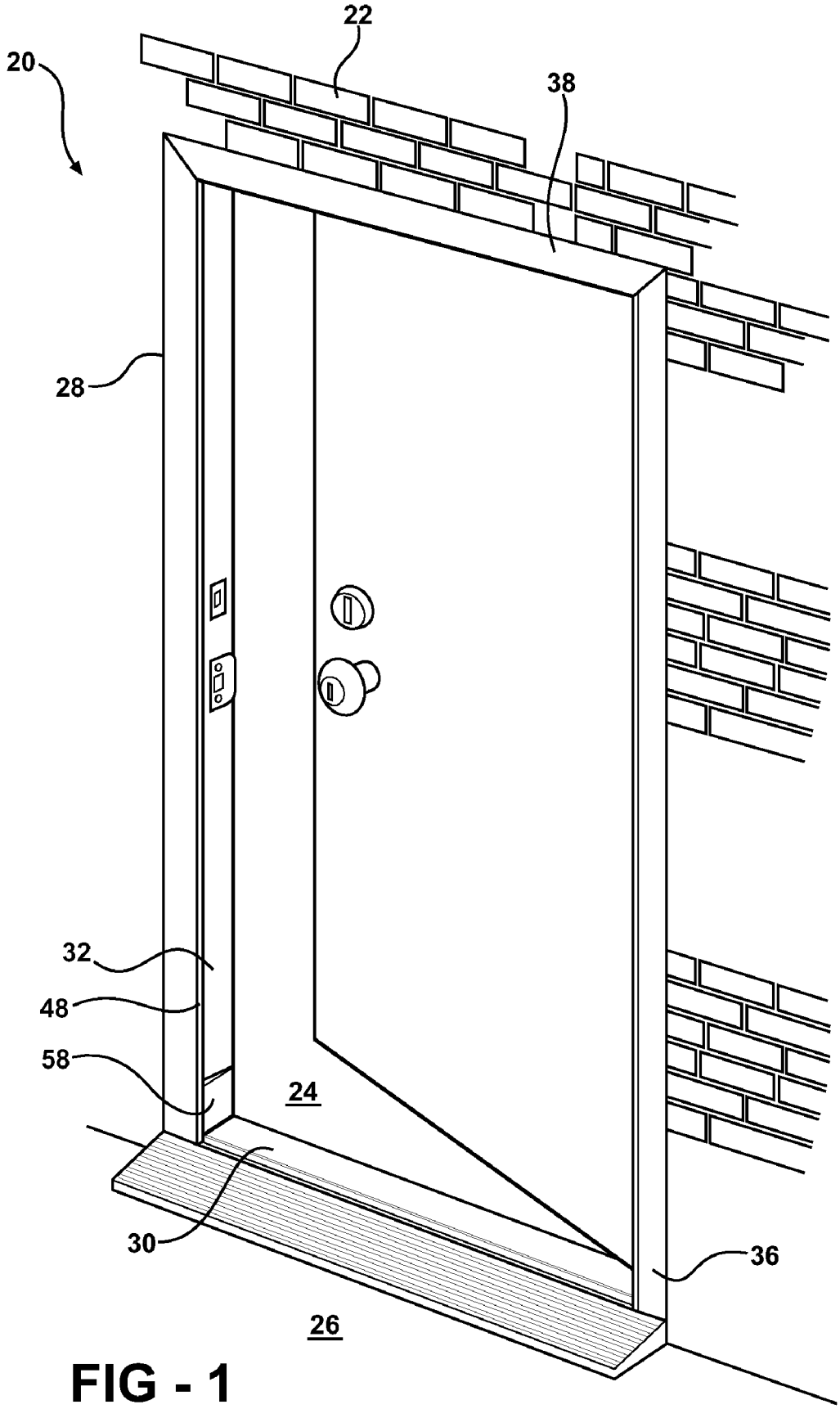
FIG. 1 is a perspective view of a door assembly including a pair of jambs.
Figure 7:
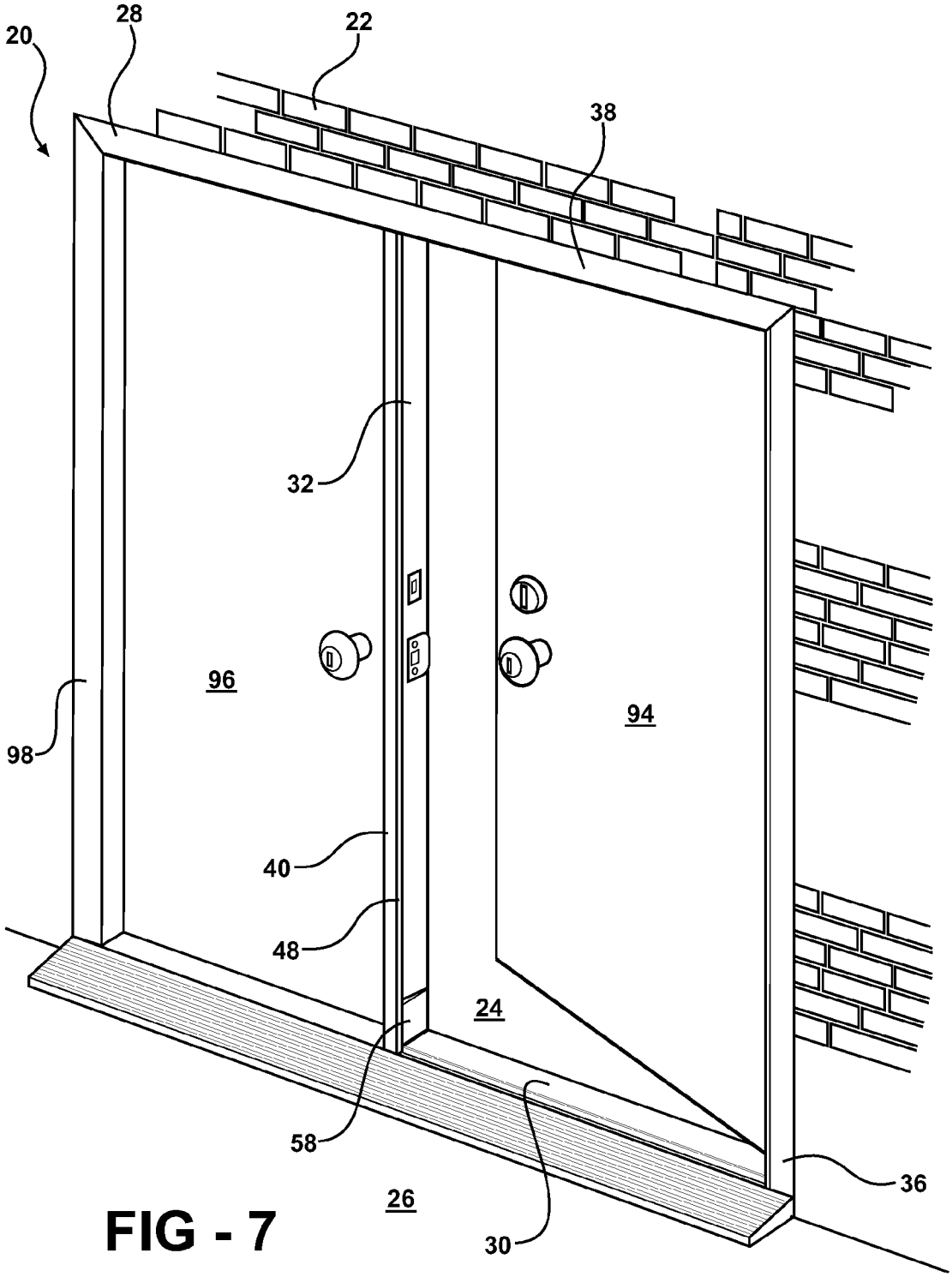
FIG. 7 is a perspective view of a door assembly including a double-door set and an astragal.

Referring to the Figures, wherein like numerals indicate corresponding parts throughout the several views, a door assembly 20 for disposition in a building 22, such as a commercial or a residential building 22, is generally shown. As shown in FIGS. 1 and 7, the door assembly 20 is mounted in a door opening of the building 22. The door assembly 20 separates an interior 24 of the building 22 from an exterior 26 of the building 22. The door assembly 20 includes a frame 28, at least one door 29 rotatably mounted to the frame 28, and a threshold 30 disposed below the door 29.

Specifically, the frame 28 of the door assembly 20 includes a vertical member 32 extending upwardly from a lower end 34, a second vertical member 36 spaced from and in parallel with the vertical member 32, and a header 38 extending generally horizontally between the vertical member 32 and the second vertical member 36. The threshold 30 is mounted in the door opening of the building 22 below the door 29 and extends generally horizontally between the vertical member 32 and the second vertical member 36 of the frame 28. As shown in FIG. 1, the vertical member 32 and the second vertical member 36 are door jambs. Alternatively, as shown in FIG. 7 and as described in greater detail below, the vertical member 32 is an astragal 40 and the second vertical member 36 is the door jamb.

Figure 2:
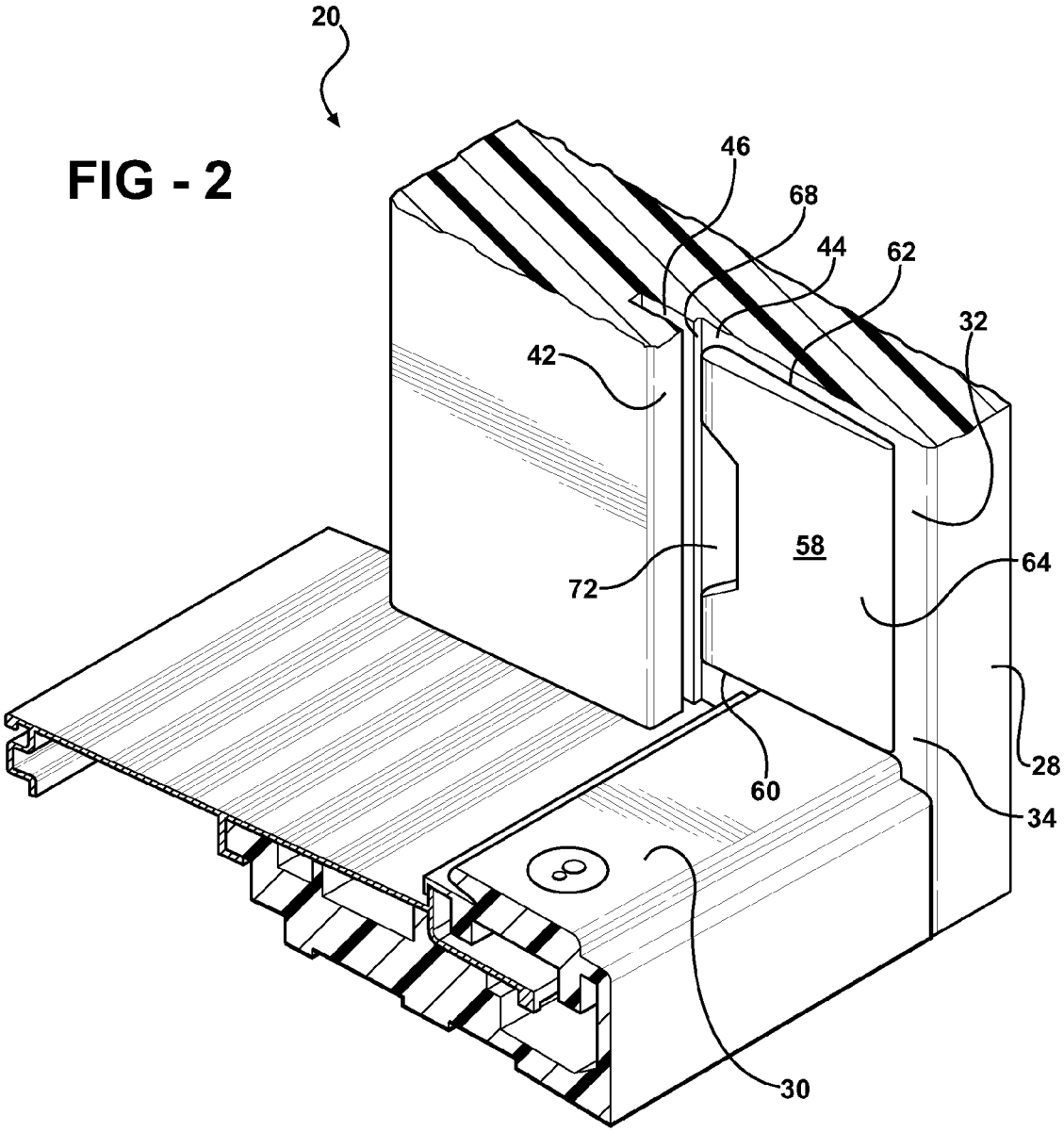
FIG. 2 is a cross-sectional view of a portion of the door assembly including a corner pad mounted to a vertical member.
Figure 3:
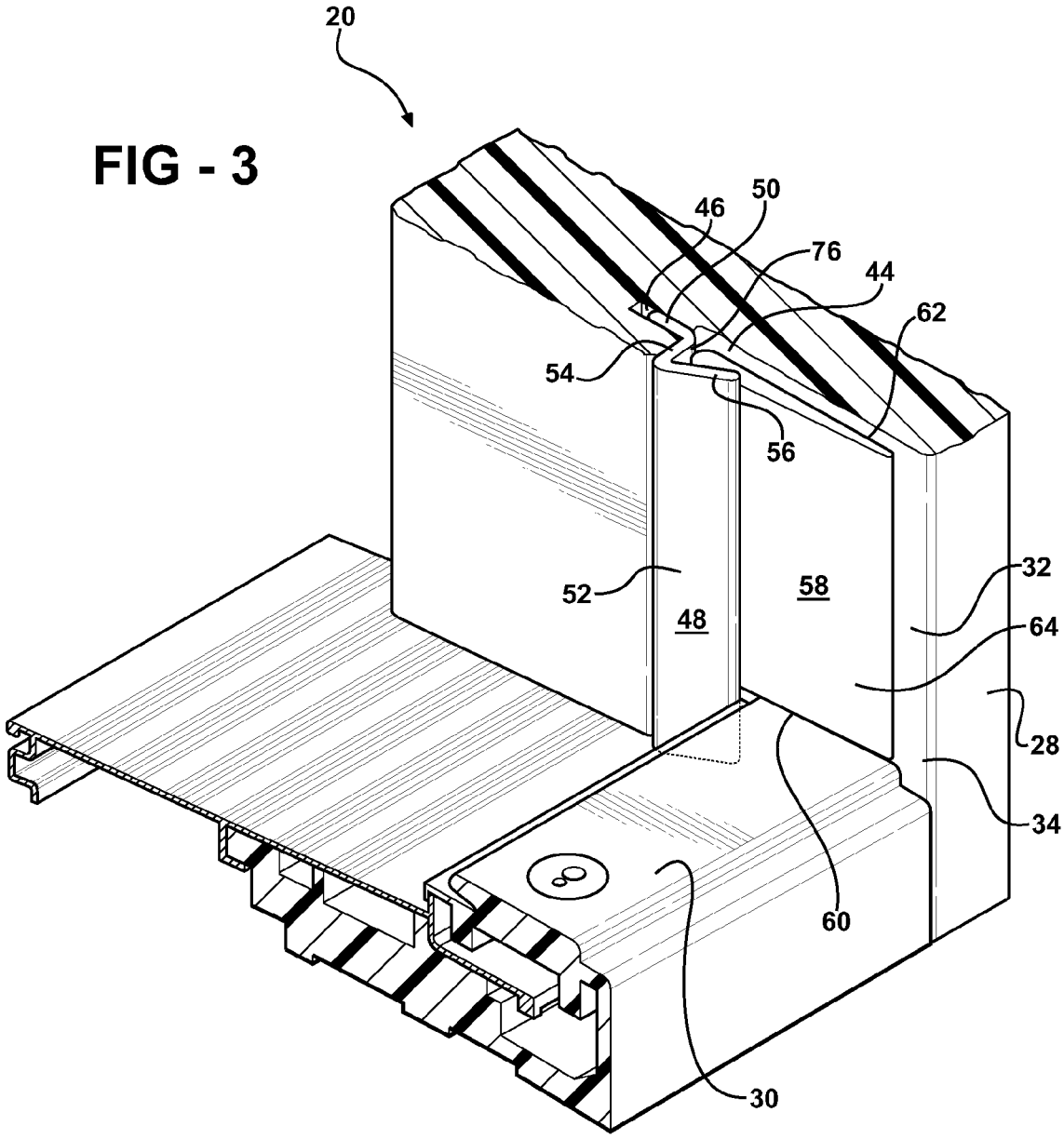
FIG. 3 is a cross-sectional view of a portion of the door assembly including a weather strip mounted to the vertical member and abutting the corner pad.

As shown in FIGS. 2-3, the vertical member 32 presents a stop surface 42 and an inset surface 44 and defines a channel 46 between the stop surface 42 and the inset surface 44. As best shown in FIG. 3, the door assembly 20 includes a weather strip 48 adjacent to and extending along the vertical member 32. The weather strip 48 includes a finger portion 50 engaged in the channel 46 of the second vertical member 36 and a leaf portion 52 extending over the stop surface 42 of the second vertical member 36. More specifically, the leaf portion 52 is V-shaped and includes a stationary leg 54 extending over the stop surface 42 and a flexible leg 56 extending from the stationary leg 54.

The door 29 is selectively moveable to be adjacent the weather strip 48 opposite the vertical member 32. Specifically, the door 29 is rotatably mounted to the second vertical member 36 and rotates about the second vertical member 36 between an open and closed position. The weather strip 48 is disposed between and seals to the door 29 and the vertical member 32 when door 29 is in a closed position to minimize the passage of water, draft, and dirt between the door 29 and the vertical member 32 from the exterior 26 of the building 22 to the interior 24 of the building 22. Specifically, when the door 29 is in the closed position, the weather strip 48 is pinched between the door 29 and the stop surface 42 of the second vertical member 36.

Figure 4A:
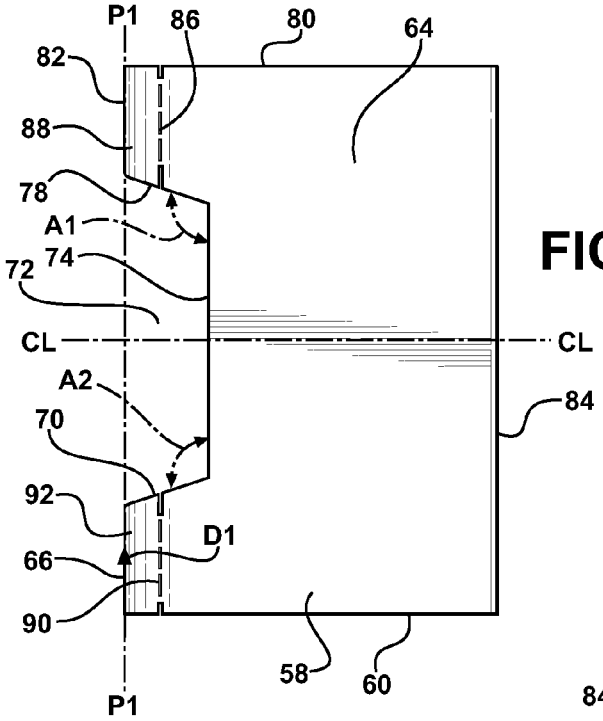
FIG. 4A is a side view of a first embodiment of the corner pad.
Figure 4B:
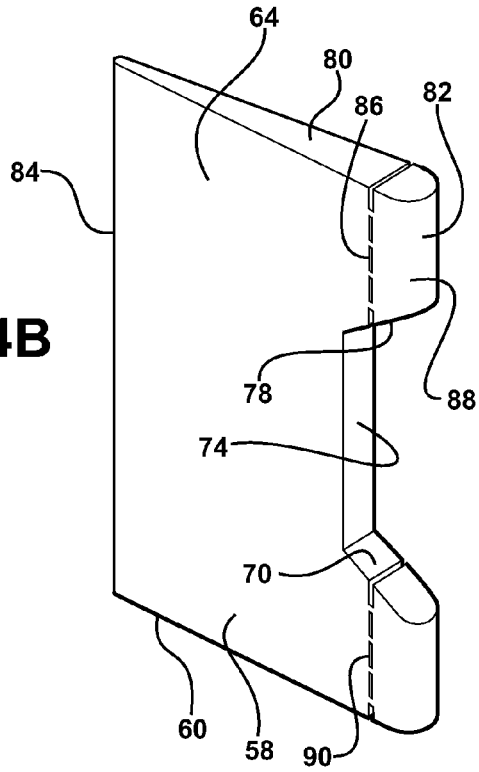
FIG. 4B is a perspective view of the first embodiment of the corner pad.
Figure 4C:
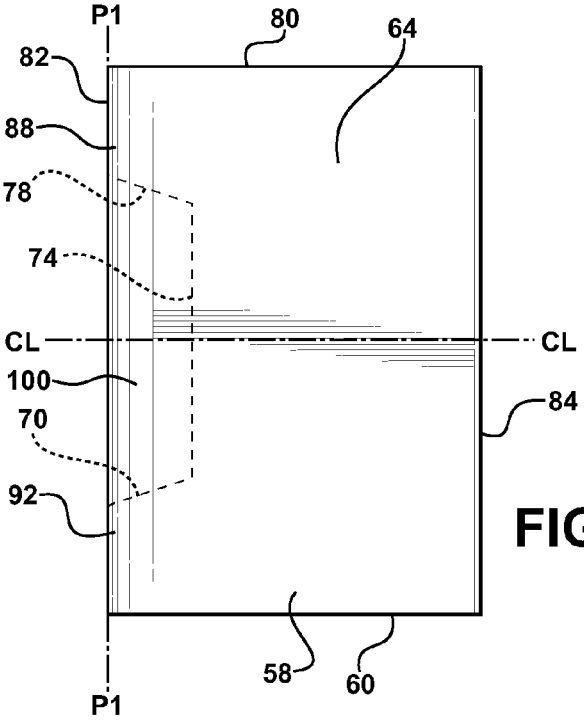
FIG. 4C is a side view of the first embodiment of the corner pad including a tear-out portion.
Figure 5:
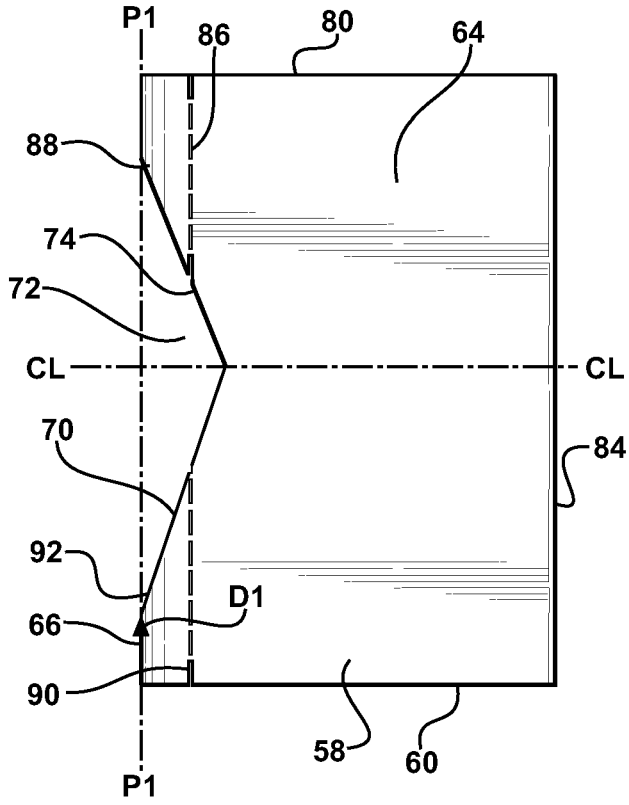
FIG. 5 is a side view of a second embodiment of the corner pad.
Figure 6:
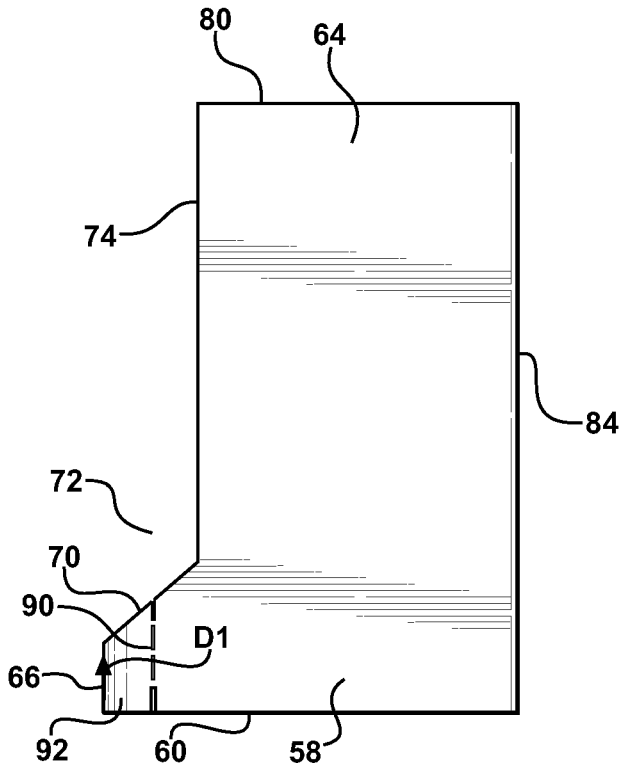
FIG. 6 is a side view of a third embodiment of the corner pad.

As shown in FIGS. 1-3 and 7, a corner pad 58 extends along a portion of the vertical member 32 at the intersection of the vertical member 32 and the threshold 30. The door assembly 20 shown in FIG. 2 does not include the weather strip 48; the weather strip 48 is shown in FIG. 3 and is not shown in FIG. 2 for illustrative purposes so as to illustrate the shape of the corner pad 58 behind the weather strip 48. FIGS. 4A-4C show a first embodiment of the corner pad 58, FIG. 5 shows a second embodiment of the corner pad 58, and FIG. 6 shows a third embodiment of the corner pad 58. FIG. 2 shows the first embodiment of the corner pad 58 mounted to the vertical member 32. It should be appreciated that the second and third embodiments of the corner pad 58 are mounted to the vertical member 32 in the same fashion as the first embodiment in FIG. 2.

The corner pad 58 reinforces the flexible leg 56 of the weather strip 48 to tightly seal between the door 29 and the vertical member 32, i.e., the corner pad 58 urges the flexible leg 56 toward the door 29. Such reinforcement of the flexible leg 56 of the weather strip 48 minimizes the passage of water, draft, and dirt between the door 29 and the vertical member 32. Specifically, rain water puddles near the door 29, especially during rain storms accompanied by high winds. In such a scenario, the corner pad 58 reinforces the flexible leg 56 to ensure that puddled water does not seep between the weather strip 48 and the door 29 and to ensure that wind does not blow puddled water between the weather strip 48 and the door 29.

The corner pad 58 is formed of an elastomeric material. For example, the corner pad 58 is formed of rubber. Alternatively, the corner pad 58 is formed of a foam material. It should be appreciated that the corner pad 58 may be formed from any material that enables the corner pad 58 to reinforce the flexible leg 56 of the weather strip 48.

As best shown in FIGS. 2-3, the corner pad 58 includes a base surface 60 disposed at the lower end 34 of the vertical member 32. The base surface 60 abuts the threshold 30 and sealingly engages the threshold 30 to prevent the passage of water, draft, and dirt between the base surface 60 and the threshold 30.

As best shown in FIG. 4B, a mounting face 62 extends in a first direction D1 from the base surface 60 and an opposite face 64 is spaced from the mounting face 62 and extends in the first direction D1 from the base surface 60. The corner pad 58 extends between the mounting face 62 and the opposite face 64 between the flexible leg 56 of the weather strip 48 and the inset surface 44 of the vertical member 32. The mounting face 62 is mounted to the vertical member 32 and the opposite face 64 biases the weather strip 48 away from the vertical member 32 toward the door 29. Specifically, as best shown in FIGS. 2-3, the mounting face 62 is mounted to the inset surface 44 of the vertical member 32. The mounting face 62 sealingly engages the vertical member 32 to prevent the passage of water, draft, and dirt between the mounting face 62 and the vertical member 32.

Specifically, adhesive is disposed between the corner pad 58 and the vertical member 32 such that the corner pad 58 is adhesively mounted to the vertical member 32. For example, an end user, such as an installer, attaches the corner pad 58 to the inset surface 44 of the vertical member 32. For example, the adhesive is double-sided tape and a backing is disposed on the double-sided tape. The end user removes the backing, inserts the corner pad 58 between the flexible leg 56 and the inset surface 44, positions the corner pad 58 on the inset surface 44 with the bottom edge abutting the threshold 30, and applies pressure to the corner pad 58 to adhere the corner pad 58 to the vertical member 32.

It should be appreciated that the corner pad 58 may be mounted to the door 29 in any manner such that the mounting face 62 sealingly engages the vertical member 32 without departing from the nature of the present invention. It should be appreciated that the corner pad 58 may also be mounted between the second vertical member 36 and the door 29 to reinforce the weather strip 48 between the second vertical member 36 and the door 29.

A first edge surface 66 extends in the first direction D1 from the base surface 60 between the mounting face 62 and the opposite face 64. In other words, the first edge surface 66 extends upwardly from the base surface 60 between the vertical member 32 and the weather strip 48. As best shown in FIG. 3, the vertical member 32 presents a lip surface 68 extending in parallel with the stop surface 42 between the channel 46 and the inset surface 44. A portion of the stationary leg 54 of the weather strip 48 is disposed between the first edge surface 66 of the corner pad 58 and the lip surface 68 of the vertical member 32.

A lower reservoir surface 70 extends from the first edge surface 66 between the mounting face 62 and the opposite face 64. The lower reservoir surface 70 extends from the first edge surface 66 away from the base surface 60 and inwardly from the first edge surface 66 defining a reservoir 72 for collecting water. In other words, the lower reservoir surface 70 extends upwardly from the first edge surface 66 and inwardly into the corner pad 58 defining the reservoir 72 between the vertical member 32 and the weather strip 48.

A second reservoir surface 74 extends angularly from the lower reservoir surface 70 for preventing the water from splashing out of the reservoir 72 and into the interior 24 of the building 22. The second reservoir surface 74 extends away from the base surface 60 between the mounting face 62 and the opposite face 64.

The reservoir 72 prevents the upward wicking of water between the flexible leg 56 and the stationary leg 54 of the weather strip 48. Specifically, during a rain storm accompanied by high wind, water puddles near the intersection of the vertical member 32 and the threshold 30 and the wind blows the puddled water against the weather strip 48. In such a scenario, the wind forms a pressure head at the door 29 in the exterior 26 of the building 22. The pressure head causes the water to wick upwardly between the flexible leg 56 and the stationary leg 54. Specifically, the water is able to wick upwardly because the flexible leg 56 and the stationary leg 54 form an elongated bore 76 and the pressure head forces the water up the elongated bore 76, i.e., referred to as the "straw effect" in industry. The upward wicking of the water is interrupted by the reservoir 72 to prevent the passage of the water up the weather strip 48 and over the corner pad 58 and into the interior 24 of the building 22.

Specifically, the lower reservoir surface 70 interrupts the elongated bore 76 formed by the flexible leg 56 and the stationary leg 54. As water wicks upwardly, the water accumulates in the reservoir 72. When the wind subsides, the water accumulated in the reservoir 72 drains downwardly between the flexible leg 56 and the stationary leg 54. Specifically, because the lower reservoir surface 70 extends downwardly from the second reservoir surface 74 toward the first edge surface 66, the downward flow of the water is unobstructed and the water drains downwardly between flexible leg 56 and the stationary leg 54.

As best shown in FIGS. 4A-C, the first embodiment of the corner pad 58 includes an upper reservoir surface 78 extending from the second reservoir surface 74 between the mounting face 62 and the opposite face 64. The upper reservoir surface 78 extends outwardly from the second reservoir surface 74 between the vertical member 32 and the weather strip 48. In such a configuration, as best shown in FIGS. 4A-C, the lower reservoir surface 70, the second reservoir surface 74, and the upper reservoir surface 78 define the reservoir 72 to be trapezoidally-shaped.

In such a configuration, both the lower and upper reservoir surfaces 70, 78 interrupt the elongated bore 76 formed by the flexible leg 56 and the stationary leg 54 of the weather strip 48. In other words, the flexible leg 56 and the stationary leg 54 form the elongated bore 76 below the lower reservoir surface 70 and above the upper reservoir surface 78. The upper reservoir surface 78 is spaced from the lower reservoir surface 70 to prevent the water from reaching the elongated bore 76 above the upper reservoir surface 78, which undesirably leads to upward wicking of water above the upper reservoir surface 78.

The upper reservoir surface 78 retains any splashing water within the reservoir 72. In other words, the upper reservoir 72 prevents water from splashing out of the reservoir 72 and over the corner pad 58 into the interior 24 of the building 22. When the upward wicking of the water is interrupted by the lower reservoir surface 70, the water rushes from the elongated bore 76 between the flexible and stationary legs 56, 54 of the weather strip 48 into the reservoir 72. Further, the pressure behind the water in the elongated bore 76 causes air to flow into the reservoir 72 and causes water droplets to spray into the reservoir 72.

The upper reservoir surface 78 prevents the water and water droplets from spraying over the corner pad 58 and into the interior 24 of the building 22. Specifically, as the air and water droplets enter the reservoir 72, the upper reservoir surface 78 causes the air and water droplets to swirl within the reservoir 72. When pressure in the elongated bore 76 subsides, i.e., when the wind subsides, the water droplets settle in the reservoir 72 and drain to the exterior 26 of the building 22 between the flexible and stationary legs 56, 54 of the weather strip 48.

The second reservoir surface 74 is vertical. The upper and lower reservoir surfaces 78, 70 each extend at a first and second obtuse angle A1, A2, respectively, relative to the second reservoir surface 74. The magnitude of the first obtuse angle A1 may be equal to or different than the magnitude of the second obtuse angle A2.

The upper reservoir surface 78 extends at the first obtuse angle A1 to accommodate the swirling of the air and water droplets in the reservoir 72. The lower reservoir surface 70 extends at the second obtuse angle A2 to accommodate the drainage of the water from the reservoir 72 between the stationary and flexible legs 54, 56 of the weather strip 48. Specifically, the upper reservoir surface 78 extends outwardly from the second reservoir surface 74 at from 105 to 110 degrees relative to the second reservoir surface 74. The lower reservoir surface 70 extends between the first edge surface 66 and the second reservoir surface 74 at from 105 to 110 degrees relative to the second reservoir surface 74.

The corner pad 58 includes a top surface 80 spaced from the base surface 60 and a second edge surface 82 extending from the upper reservoir surface 78 to the top surface 80 between the mounting face 62 and the opposite face 64. In other words, the second edge surface 82 extends between the vertical member 32 and the weather strip 48. Specifically, the second edge surface 82 extends in the first direction D1 from the upper reservoir surface 78 to the top surface 80.

More specifically, the first edge surface 66 extends in a first plane P1 and the upper reservoir surface 78 extends from the second reservoir surface 74 to the first plane P1. The second edge surface 82 extends along the first plane P1 between the upper reservoir surface 78 and the top surface 80. A portion of the stationary leg 54 of the weather strip 48 is disposed between the second edge surface 82 and the lip surface 68.

The corner pad 58 is symmetrical about a centerline CL through the second reservoir surface 74. Specifically, the first and second edge surfaces 66, 82 are equal in length and extend vertically, the lower and upper reservoir surfaces 70, 78 are equal in length, and the second reservoir surface 74 extends vertically. The first plane P1 extends vertically, i.e., the first direction D1 extends perpendicular relative to the base surface 60, such that the first and second edge surfaces 66, 82 extend vertically. It should be appreciated that the term perpendicular is used herein to refer to extension at approximately 90°. The corner pad 58 is symmetrical so that the corner pad 58 is non-handed, i.e., may be used in right-hand door and in a left-hand door. In other words, in a configuration where the corner pad 58 is mounted to the vertical member 32 of a right-handed door with the mounting surface abutting the vertical member 32 and the base surface 60 abutting the threshold 30, the corner pad 58 may be flipped to accommodate a left-handed door with the mounting surface abutting the vertical member 32 and with the top surface 80 abutting the threshold 30. Further, because the corner pad 58 is non-handed, the corner pad 58 is mountable to both a hinge side of the frame 28 and a striker side of the frame 28.

As best shown in FIG. 4B, the corner pad 58 presents an interior edge surface 84 facing the interior 24 of the building 22. The corner pad 58 tapers inwardly along the top surface 80 from the second edge surface 82 toward the interior edge surface 84. In other words, the corner pad 58 is wedge-shaped. As best shown in FIGS. 2, 3, and 4B, the corner pad 58 is rounded at the first edge surface 66, the second edge surface 82, and the interior edge surface 84. It should be appreciated that the corner pad 58 may be of any width, thickness, or height without departing from the nature of the present invention.

As best shown in FIG. 4A, the corner pad 58 defines a perforated line 86 extending from the top surface 80 to the upper reservoir surface 78 defining a removeable ear portion 88 for accommodating a geometry of components of the door assembly 20. The corner pad 58 also defines a second perforated line 90 extending from the base surface 60 to the lower reservoir surface 70 defining a second removeable ear portion 92 for removal to accommodate a geometry of components of the door assembly 20. Specifically, vertical members 32 of different door assemblies 20 may have varying geometries. For example, the vertical member 32 of one door assembly 20 may have a geometry that accommodate the corner pad 58 including with the ear portion and the second ear portion whereas the vertical member 32 of another door assembly 20 may have a geometry that requires the removeable ear portion 88 to be removed such that the corner pad 58 fits against the inset surface 44 of the vertical member 32.

The perforated line 86 and the second perforated line 90 extend in a common direction such that the corner pad 58 is non-handed, i.e., may be used in right-hand door and in a left-hand door. It should be appreciated that the perforated line 86 and the second perforated line 90 may be offset from each other without departing from the nature of the present invention.

As shown in FIG. 5, in the second embodiment of the corner pad 58, the second reservoir surface 74 extends from the lower reservoir surface 70 toward the first plane P1. Specifically, the second reservoir surface 74 extends to the first plane P1 and the second edge extends from second reservoir surface 74 to the top surface 80 between the mounting face 62 and the opposite face 64. In other words, in such a configuration the reservoir 72 is triangularly shaped.

In such a configuration, both the lower reservoir surface 70 and the second reservoir surface 74 interrupt the elongated bore 76 formed by the flexible leg 56 and the stationary leg 54 of the weather strip 48. In other words, the flexible leg 56 and the stationary leg 54 form the elongated bore 76 below the lower reservoir surface 70 and above the second reservoir surface 74. The second reservoir surface 74 is spaced from the lower reservoir surface 70 to prevent the water from reaching the elongated bore 76 above the second reservoir surface 74, which undesirably leads to upward wicking of water above the second reservoir surface 74.

The second reservoir surface 74 retains any splashing water within the reservoir 72. In other words, the second reservoir 72 prevents water from splashing out of the reservoir 72 and over the corner pad 58 into the interior 24 of the building 22. When the upward wicking of the water is interrupted by the lower reservoir surface 70, the water rushes from the elongated bore 76 between the flexible and stationary legs 56, 54 of the weather strip 48 into the reservoir 72. Further, the pressure behind the water in the elongated bore 76 causes air to flow into the reservoir 72 and causes water droplets to spray into the reservoir 72.

The second reservoir surface 74 prevents the water and water droplets from spraying over the corner pad 58 and into the interior 24 of the building 22. Specifically, as the air and water droplets enter the reservoir 72, the second reservoir surface 74 causes the air and water droplets to swirl within the reservoir 72. When pressure in the elongated bore 76 subsides, i.e., when the wind subsides, the water droplets settle in the reservoir 72 and drain to the exterior 26 of the building 22 between the flexible and stationary legs 56, 54 of the weather strip 48.

The top surface 80 is spaced from the base surface 60 and the second edge surface 82 extends from the second reservoir surface 74 to the top surface 80 between the mounting face 62 and the opposite face 64. In other words, the second edge surface 82 extends between the vertical member 32 and the weather strip 48. Specifically, the second edge surface 82 extends in the first direction D1 from the upper reservoir surface 78 to the top surface 80.

More specifically, the first edge surface 66 extends in the first plane P1 and the upper reservoir surface 78 extends from the second reservoir surface 74 to the first plane P1. The second edge surface 82 extends along the first plane P1 between the upper reservoir surface 78 and the top surface 80. A portion of the stationary leg 54 of the weather strip 48 is disposed between the second edge surface 82 and the lip surface 68.

The corner pad 58 of the first embodiment is symmetrical about the centerline CL. Specifically, the first and second edge surfaces 66, 82 are equal in length and extend vertically, the lower and second reservoir surfaces 70, 74 are equal in length. The first plane P1 extends vertically, i.e., the first direction D1 extends perpendicular relative to the base surface 60, such that the first and second edge surfaces 66, 82 extend vertically. It should be appreciated that the term perpendicular is used herein to refer to extension at approximately 90°. The corner pad 58 is symmetrical so that the corner pad 58 is non-handed, i.e., may be used in right-hand door and in a left-hand door. In other words, in a configuration where the corner pad 58 is mounted to the vertical member 32 of a right-handed door with the mounting surface abutting the vertical member 32 and the base surface 60 abutting the threshold 30, the corner pad 58 may be flipped to accommodate a left-handed door with the mounting surface abutting the vertical member 32 and with the top surface 80 abutting the threshold 30.

As shown in FIG. 6, in the third embodiment of the corner pad 58, the second reservoir surface 74 extends upwardly from the lower reservoir surface 70 to the top surface 80. It should be appreciated that the second reservoir surface 74 defines a length between the lower reservoir surface 70 and the top surface 80 such that the second reservoir surface 74 prevents the water from splashing out of the reservoir 72 and into the interior 24 of the building 22. It should be appreciated that the shapes of the reservoir 72 of the first, second, and third embodiments are exemplary and the reservoir 72 may be any shape without departing from the nature of the present invention.

As shown in FIG. 7, the vertical member 32 is the astragal 40 of a double-door set. The double-door set is rotatably mounted to the frame 28. In such a configuration, the door 29 is further defined as an active door 94 of the double-door set. Specifically, the double-door set includes the active door 94 rotatably mounted to the vertical member 32 of the frame 28 and a semi-active door 96 rotatably mounted to a third vertical member 98 of the frame 28. The active door 94 and the semi-active door 96 rotate relative to the first vertical member 32 and the third vertical member 98, respectively, such that the doors 94, 96 may independently swing between an open position and a closed position. The astragal 40 is disposed on a free end of the semi-active door 96. The astragal 40 extends between the active door 94 and the semi-active door 96 from the threshold 30 to the header 38 when the doors 94, 96 are in the closed position. In the second embodiment of the door assembly 20, the corner pad 58 may also be mounted between the semi-active door 96 and the astragal 40 and between the semi-active door 96 and the third vertical member 98.

As shown in FIG. 4C, the corner pad 58 includes a tear-out portion 100. In such a configuration, the corner pad 58 is shipped unattached to the astragal 40. The end user, such as the installer, removes the tear-out portion 100 prior to attaching the corner pad 58 to the vertical member 32. The tear-out portion 100 is arranged in the reservoir 72 such that the corner pad 58 is rectangular in shape prior to removal of the tear-out portion 100. The tear-out portion 100 is connected to the lower reservoir surface 70, the second reservoir surface 74, and the upper reservoir surface 78 and the corner pad 58 defines perforations between the tear-out portion 100 and each of the lower reservoir surface 70, the second reservoir surface 74, and the upper reservoir surface 78.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A corner pad for disposition in a door assembly in a building, said corner pad comprising:

a base surface;

a mounting face extending in a first direction from said base surface;

an opposite face spaced from said mounting face and extending in said first direction from said base surface;

a first edge surface extending in said first direction from said base surface between said mounting face and said opposite face;

a lower reservoir surface extending from said first edge surface between said mounting face and said opposite face and extending from said first edge surface away from said base surface and inwardly from said first edge surface defining a reservoir for collecting water;

a second reservoir surface extending from said lower reservoir surface between said mounting face and said opposite face and extending from said lower reservoir surface angularly relative to said lower reservoir surface for preventing the water from splashing out of the reservoir and into an interior of the building; and an upper reservoir surface extending from said second reservoir surface between said mounting face and said opposite face and extending outwardly from said second reservoir surface;

said upper reservoir surface extending from said second reservoir surface at from 105 to 110 degrees relative to said second reservoir surface.

2. The corner pad as set forth in claim 1 wherein said first edge surface extends in a first plane and wherein said upper reservoir surface extends from said second reservoir surface toward said first plane.

3. The corner pad as set forth in claim 1 further comprising a top surface spaced from said base surface and further comprising a second edge surface extending from said upper reservoir surface to said top surface between said mounting face and said opposite face.

4. The corner pad as set forth in claim 3 wherein said first edge surface extends in a first plane and wherein said upper reservoir surface extends to said first plane and said second edge surface extends along said first plane between said upper reservoir surface and said top surface.

5. The corner pad as set forth in claim 3 further comprising a perforated line extending from said top surface to said upper reservoir surface defining a removeable ear portion for accommodating a geometry of the door assembly.

6. The corner pad as set forth in claim 5 further comprising a second perforated line extending from said base surface to said lower reservoir surface defining a second removeable ear portion for removal to accommodate a geometry of components of the door assembly.

7. The corner pad as set forth in claim 1 further comprising a top surface spaced from said base surface.

8. The corner pad as set forth in claim 1 wherein said lower reservoir surface extends between said first edge surface and said second reservoir surface at from 105 to 110 degrees relative to said second reservoir surface.

9. The corner pad as set forth in claim 1 wherein said first direction is perpendicular relative to said base surface.

10. The corner pad as set forth in claim 1 wherein said corner pad is formed of an elastomeric material.

11. The corner pad as set forth in claim 1 further comprising adhesive disposed on said mounting face.

12. A door assembly for disposition in a building, said door assembly comprising:

a vertical member extending upwardly from a lower end;

a weather strip adjacent said vertical member;

a door selectively moveable to be adjacent said weather strip opposite said vertical member; and a corner pad including a base surface disposed at said lower end of said vertical member, a first edge surface extending upwardly from said base surface between said vertical member and said weather strip, and a lower reservoir surface extending upwardly from said first edge surface and inwardly into said corner pad defining a reservoir between said vertical member and said weather strip;

said corner pad including a second reservoir surface extending angularly from said lower reservoir surface for preventing water from splashing out of said reservoir and into an interior of the building;

said corner pad including an upper reservoir surface extending outwardly from said second reservoir surface between said vertical member and said weather strip;

said weather strip defining an elongated bore along said corner pad; and said upper reservoir surface being spaced from said lower reservoir surface for interrupting said elongated bore to prevent passage of the water up said weather strip and over said corner pad.

13. The door assembly as set forth in claim 12 wherein said corner pad includes a top surface spaced from said base surface and includes a second edge surface extending upwardly from said upper reservoir surface to said top surface between said vertical member and said weather strip.

14. The door assembly as set forth in claim 13 wherein said first edge surface extends in a first plane and wherein said upper reservoir surface extends to said first plane and said second edge surface extends along said first plane between said upper reservoir surface and said top surface.

15. The door assembly as set forth in claim 13 wherein said corner pad defines a perforated line extending from said top surface to said upper reservoir surface defining a removeable ear portion for accommodating a geometry of components of said door assembly.

16. The door assembly as set forth in claim 12 wherein said first edge surface extends vertically from said base surface and wherein said lower reservoir surface extends between said first edge surface and said second reservoir surface at between 105 and 110 degrees relative to said second reservoir surface.

17. The door assembly as set forth in claim 16 wherein said corner pad defines a second perforated line extending from said base surface to said lower reservoir surface defining a second removeable ear portion for removal to accommodate a geometry of components of said door assembly.

18. The door assembly as set forth in claim 12 wherein said corner pad is formed of an elastomeric material.

19. The door assembly as set forth in claim 12 further comprising a top surface spaced from said base surface.

20. The door assembly as set forth in claim 12 further comprising a threshold extending from said lower end of said vertical member with said base surface of said corner pad abutting said threshold.

21. The door assembly as set forth in claim 12 further comprising adhesive disposed between said corner pad and said vertical member.

22. The corner pad as set forth in claim 1 wherein said second reservoir surface extends upwardly from said lower reservoir surface in a direction away from said base surface.

23. The corner pad as set forth in claim 1 wherein said second reservoir surface extends upwardly from said lower reservoir surface perpendicularly relative to said base surface.

24. A door assembly for disposition in a building, said door assembly comprising:

a vertical member extending upwardly from a lower end;

a weather strip adjacent said vertical member;

a door selectively moveable to be adjacent said weather strip opposite said vertical member; and a corner pad including a base surface disposed at said lower end of said vertical member, a first edge surface extending upwardly from said base surface between said vertical member and said weather strip, and a lower reservoir surface extending upwardly from said first edge surface and inwardly into said corner pad defining a reservoir between said vertical member and said weather strip;

said corner pad including a second reservoir surface extending angularly from said lower reservoir surface for preventing water from splashing out of said reservoir and into an interior of the building;

said corner pad including an upper reservoir surface extending outwardly from said second reservoir surface between said vertical member and said weather strip; and said first edge surface extending vertically from said base surface, said lower reservoir surface extending between said first edge surface and said second reservoir surface at between 105 and 110 degrees relative to said second reservoir surface.

25. The door assembly as set forth in claim 24 wherein said corner pad includes a top surface spaced from said base surface and includes a second edge surface extending upwardly from said upper reservoir surface to said top surface between said vertical member and said weather strip.

* * * * *

UNITED STATES PATENT AND TRADEMARK OFFICE

CERTIFICATE OF CORRECTION

PATENT NO. : 8,240,090 B2
APPLICATION NO. : 11/779040
DATED : August 14, 2012
INVENTOR(S) : James W. Meeks et al.

It is certified that error appears in the above-identified patent and that said Letters Patent is hereby corrected as shown below:

In the Claims:

Column 11, line 26, after "as set forth in," delete "claim 16" and insert therein -- claim 15 --.

Signed and Sealed this
Twenty-third Day of July, 2013

Teresa Stanek Rea
*Acting Director of the United States Patent and Trademark Office*